US005400942A

United States Patent [19]

Gast et al.

[11] Patent Number: 5,400,942

[45] Date of Patent: Mar. 28, 1995

[54] AUTOMATIC FASTENER FEED APPARATUS AND METHOD

[75] Inventors: Robert L. Gast, Tustin; David G. Delgado, Rancho Cucamonga, both of Calif.

[73] Assignee: Textron Inc., Providence, R.I.

[21] Appl. No.: 64,744

[22] Filed: May 19, 1993

Related U.S. Application Data

[63] Continuation of Ser. No. 843,010, Feb. 28, 1992, abandoned.

[51] Int. Cl.[6] ..... B21J 15/32; B21J 15/38

[52] U.S. Cl. ..... 227/112

[58] Field of Search ..... 227/112, 52; 72/391; 29/809, 243.53

[56] References Cited

U.S. PATENT DOCUMENTS

| | | |
|---|---|---|
| 3,658,230 | 4/1972 | Enock . |
| 4,059,981 | 11/1977 | Holloway . |
| 4,205,547 | 6/1980 | Yamasaka . |
| 4,586,362 | 5/1986 | Dean et al. . |
| 4,604,889 | 8/1986 | Sukharevsky . |
| 4,643,344 | 2/1987 | Kaita . |
| 4,747,294 | 5/1988 | Schwartz et al. . |
| 4,754,643 | 7/1988 | Weeks, Jr. et al. . |
| 4,765,175 | 8/1988 | Denham et al. . |
| 4,790,470 | 12/1988 | Miles . |
| 4,852,376 | 8/1989 | Suhov . |
| 4,901,431 | 2/1990 | Gast . |
| 4,972,985 | 11/1990 | Smart et al. . |
| 4,988,028 | 1/1991 | Smart et al. . |
| 5,014,894 | 5/1991 | Smart . |
| 5,036,576 | 8/1991 | Gast . |

FOREIGN PATENT DOCUMENTS

| | | |
|---|---|---|
| 0284257 | 9/1988 | European Pat. Off. . |
| 0458534 | 11/1991 | European Pat. Off. . |
| 0491193 | 6/1992 | European Pat. Off. . |
| 2155834 | 10/1985 | United Kingdom . |

OTHER PUBLICATIONS

"Retooling Your Robot", Manufacturing Engineer, Nov. 1990.

*Primary Examiner*—Joseph M. Gorski

*Attorney, Agent, or Firm*—Knobbe, Martens, Olson & Bear

[57] ABSTRACT

An automated device for presenting fastener assemblies to the nosepiece of a fastener-setting tool as quickly as possible with the least amount of error. A pair of fingers connected to a tubular shaft and activated by a pneumatic piston assembly grip the fastener stem close to but spaced from the stem tip; and a second pneumatic piston assembly to displace the device towards the tool to physically insert the fastener stem into the nosepiece of the tool.

2 Claims, 10 Drawing Sheets

AUTOMATIC FASTENER FEED APPARATUS AND METHOD

This application is a continuation of application Ser. No. 07/843,010, filed Feb. 28, 1992, now abandoned.

FIELD OF THE INVENTION

This invention relates to an apparatus for loading a fastener assembly into a nosepiece of a fastener-setting tool.

BACKGROUND OF THE INVENTION

The term "fastener assembly," such as a blind fastener or rivet, describes a fastener body comprising a head and a hollow deformable sleeve surrounding a stem having an enlarged head and a stem pull portion extending beyond the sleeve. The stem pull portion is pulled and eventually broken away from the fastener assembly by the tool after the fastener is set in a workpiece. The deformable sleeve locks the fastener in place.

In one method of automatically installing a blind fastener into a workpiece, a fastener assembly is transmitted from a fastener feeder to a fastener receive and place unit, which will take the received fastener and load it into the nosepiece of the fastener-setting tool. The receive and place unit is then moved out of the way, and the tool installs and sets the fastener in the workpiece. The cycle is repeated as needed.

The objective of an automatic fastener loading apparatus is to load a fastener into the fastener-setting tool as quickly as possible with the least amount of error. In view of the enormous number of fasteners used, even small improvements in the installation process can be very valuable.

Some devices used to load fasteners have employed a method of bringing the fastener close to but not touching the nosepiece of the tool and then pneumatically blowing the fastener into the nosepiece of the tool. This method of utilizing a positive burst of air led to may errors due to the fact that the fastener had to travel through the air before entering the tool.

This inaccuracy was compounded by the prior method of aligning the fastener to the tool. The prior devices held the fasteners in channels where they would in turn be shot into the tool. Alignment of a fastener by merely placing it in a channel with no other guiding means proved faulty.

Thus, to overcome this problem, prior devices have employed grippers to grip the fastener to aid the insertion into the nosepiece of the fastener-setting tool.

Prior devices utilized grippers in two different methods but both were still flawed. One type of gripper gripped the sleeve portion of the fastener, but since the stem pull portion, which is the part of the fastener which is inserted into the tool is still unguided, the accuracy of the loading method was low. This was especially apparent, since many fastener stems are not completely straight, and instead tend to have a slight natural curvature. Thus, although the sleeve may have been aligned with the nosepiece of the tool, it did not necessarily mean that the stem was aligned also.

A second type of device utilized fingers or jaws that appear like grippers but did not actually grip the stem pull portion of the fastener. Instead, the grippers utilized in these devices served mainly as a channel for guiding the fasteners into the nosepiece of the tool. The load cycle times for both these types of devices were relatively slow.

The accuracy of loading a fastener is especially important when dealing with staking tools which displace the material of the fastener body head or stem when setting the fastener. The difference between the diameter of the opening of the bore of the nosepiece of a staking tool and the diameter of the stem pull portion of a fastener is so small that minor misalignments can prevent the stem from entering the tool.

Therefore, there appears to be a need for a device to fulfill the objective of automatically loading a fastener assembly into the nosepiece of a fastener-setting tool as quickly as possible and as accurately as possible to ensure efficient loading.

SUMMARY OF THE INVENTION

In accordance with the present invention there is provided an improved means for loading a fastener assembly to a nosepiece of a fastener-setting tool. The present device comprises a fastener receive and place module containing a vacuum channel for holding the sleeve and the stem head portion of the fastener in place, while the fastener is aligned to be inserted into the bore of the nosepiece of the fastener-setting tool. The module, in addition, contains fingers to grip the stem pull portion of the fastener assembly to further aid in the accuracy of the insertion into the tool. The grippers are actuated through the use of a pneumatic piston assembly or other suitable means. The module contains a second pneumatic piston assembly or other such means to physically insert the fastener stem pull portion into the nosepiece of the fastener-setting tool. The physical gripping and insertion of the fastener stem, as opposed to a blast of positive air propelling the stem into the tool, produces a more accurate result.

In operation, the receive and place module receives a fastener from a feeder tube with its fingers in the open position. The fastener will be propelled into the channel of the module, preferably by air pressure, and held there by a vacuum suction. The sleeve of the fastener body in addition to the stem head is inserted into the channel with the stem pull portion extending outwardly. The channel contains a sensor which is connected to a control unit which will determine through pressure differentials, when the fastener is placed within the channel. Once the control unit senses that the fastener is in place, the loading cycle will begin. The module will move forward along a slide and align itself with the nosepiece of the fastener-setting tool. During this forward movement, the fingers will simultaneously close, gripping the stem close to, but spaced from the outer tip of the stem pull portion. A portion of the module, including the fingers, is then physically extended to insert the fastener into the bore of the nosepiece of the fastener-setting tool. Once the tip of the stem pull portion is inserted into the bore, the vacuum in the channel is replaced by a positive air pressure to complement the vacuum suction that is created within the bore of the tool. Then, the fingers will open, thus propelling the fastener further into the bore. Once this is accomplished, the fingers are retracted and the module moved laterally to receive another fastener assembly to restart the whole cycle. Once the module is realigned with the feeder tube, the load cycle is complete. The complete load cycle, in one form of the invention, only takes approximately 0.6 second.

There now follows a detailed description, to be read with reference to the accompanying drawings, of the present fastener assembly loading device in accordance with the invention. This apparatus has been selected for description by way of example, and not of limitation of the invention.

DETAILED DESCRIPTION OF THE PREFERRED EMBODIMENT

Figure 1:
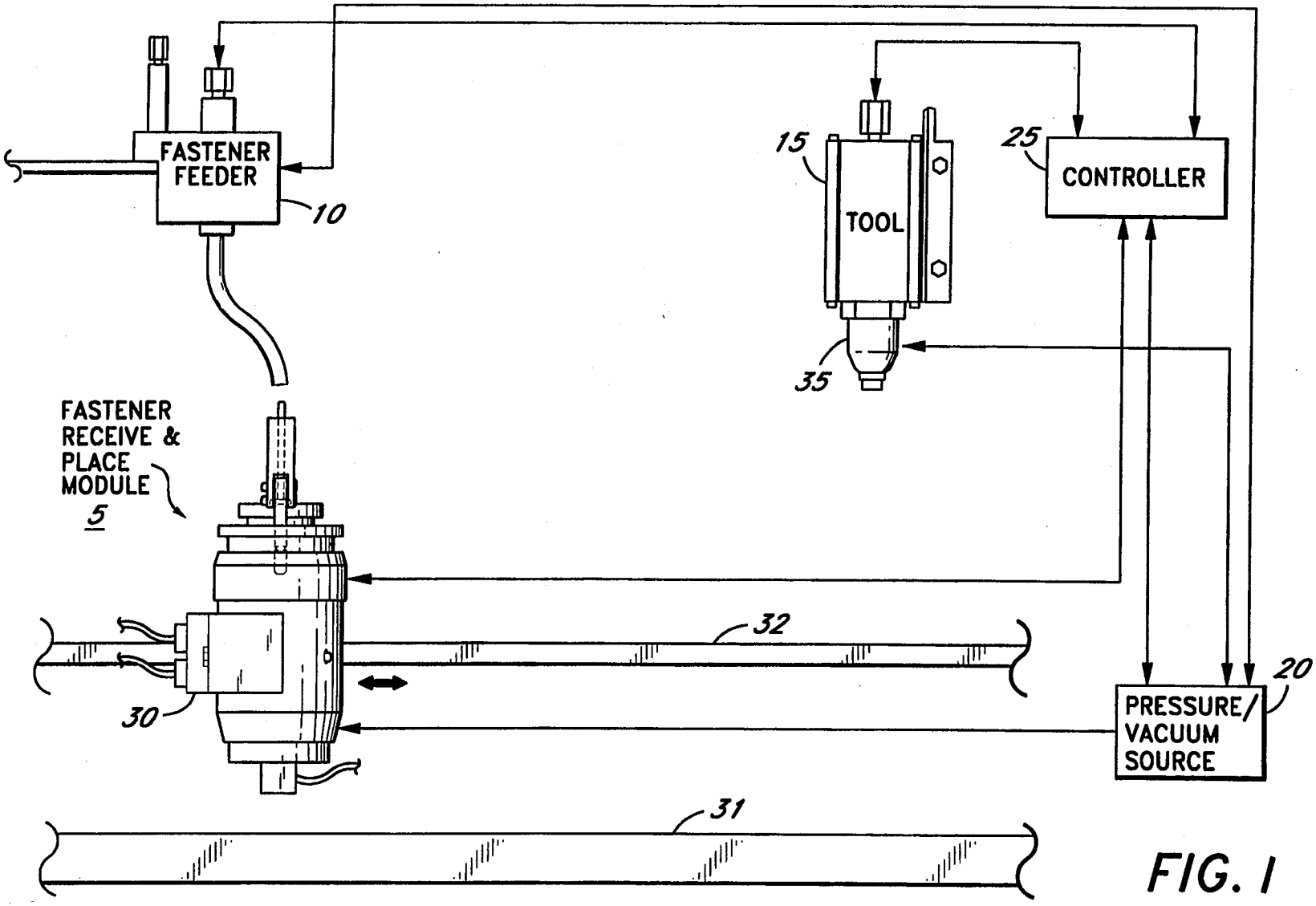
FIG. 1 is a schematic side elevational view of the powered fastener loading apparatus of the present invention in relation to a fastener installation assembly.

FIG. 1 shows the powered fastener loading apparatus of the present invention including a fastener receive and place module 5, a fastener feeder 10, a fastener-setting tool 15, a pressure source and vacuum 20, and a control unit 25. In one embodiment, the fastener receive and place module 5 is secured to a support structure 30 which is linked to a linear front slide 32 that is elevated above a table 31. However it is conceivable to have the module 5 and support structure 30 secured to the perimeter of a rotating structure. Thus, the module 5 would move via a circumferential path. In a preferred embodiment, the combination of the module 5 and the front slide 32 are in turn connected to a rear slide (not shown). The rear slide which is slower than the front slide 32, moves the module 5 from a location outside of the installation cycle to a position Where the module 5 is aligned with the feeder 10. However, the rear slide is only a design option and is not necessary for the operation of the module 5. The objectives of this invention can be accomplished without the use of the rear slide. A longer front slide 32 can replace the operation of an additional rear slide. The front slide 32 shuttles the module 5 back and forth very quickly between the feeder 10 and the tool 15. The tool 15 is able to move vertically but not horizontally; thus, the workpiece (not shown) is always positioned beneath the tool 15 during the installation cycle. The control unit 25 is in constant communication with the other elements of the system. A pressure source 20, such as shop air, supplies pneumatic pressure to the fastener receive and place module 5, the fastener feeder 10 and the fastener-setting tool 15. As a design option, an additional pneumatic hydraulic intensifier can be utilized to help power the fastener-setting tool during the setting of the fastener. The accompanying vacuum source provides the vacuum suction located within the module 5. The fastener feeder 10, the fastener-setting tool 15, the control unit 25, and the pressure source with vacuum 20 are of a known industrial design. One example of a suitable controller includes an Allen Bradly SLC 500 Electronic Processor.

Figure 6:
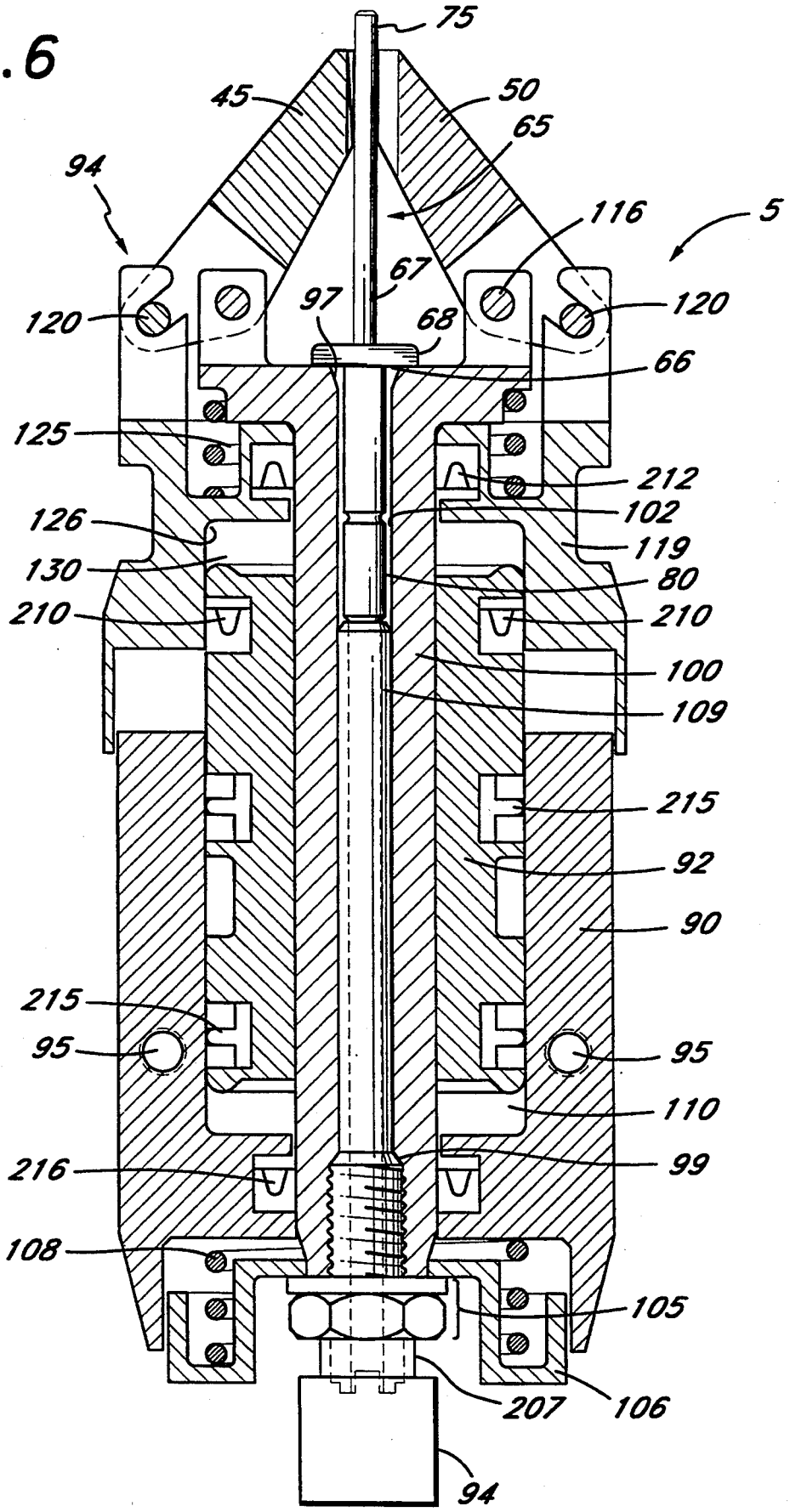
FIG. 6 is a cross-sectional view of the module of FIG. 4 displaced in an axial direction with the fingers in the closed position gripping a fastener assembly.

FIG. 6 shows a typical blind fastener assembly 65 located within the fastener receive and place module 5. The fastener assembly 65 comprises a fastener body or sleeve 66 surrounding a stem 67, with an enlarged head 68 on one end. The stem 67 comprises a stem pull portion 75 extending outwardly from the head end of the sleeve 66 and a head 80 extending outwardly from the tail end of the sleeve 66. The sleeve 66 and the stem head 80 are shown positioned within a channel 102 of the module 5.

Referring now to FIGS. 3–7, the module 5 includes an outer cylindrical housing 90 mounted on a support structure 30 (shown in FIG. 1) through mounting holes 95. A tubular displacement spool 92 is slidable axially within the interior of the housing 90. A tubular displacement shaft 100 extends through the interior bore of the displacement spool and is connected to the spool by a compression spring pin 98, shown in FIG. 4, causing those components to move as a unit, that is in effect a piston. The rear of the displacement shaft extends through an end wall of the housing 90 whereby a pneumatically expandable displacement chamber 110 is formed by the axial end face of the spool 92, together with the housing end wall and an exterior portion of the shaft 100. An air inlet or exhaust passage 112 connects the chamber 110 to a valve (not shown) which is located in between the air supply 20 and the passage 112. Suitable annular seals 215 and 216 seal the axial ends of the chamber.

Figure 4:
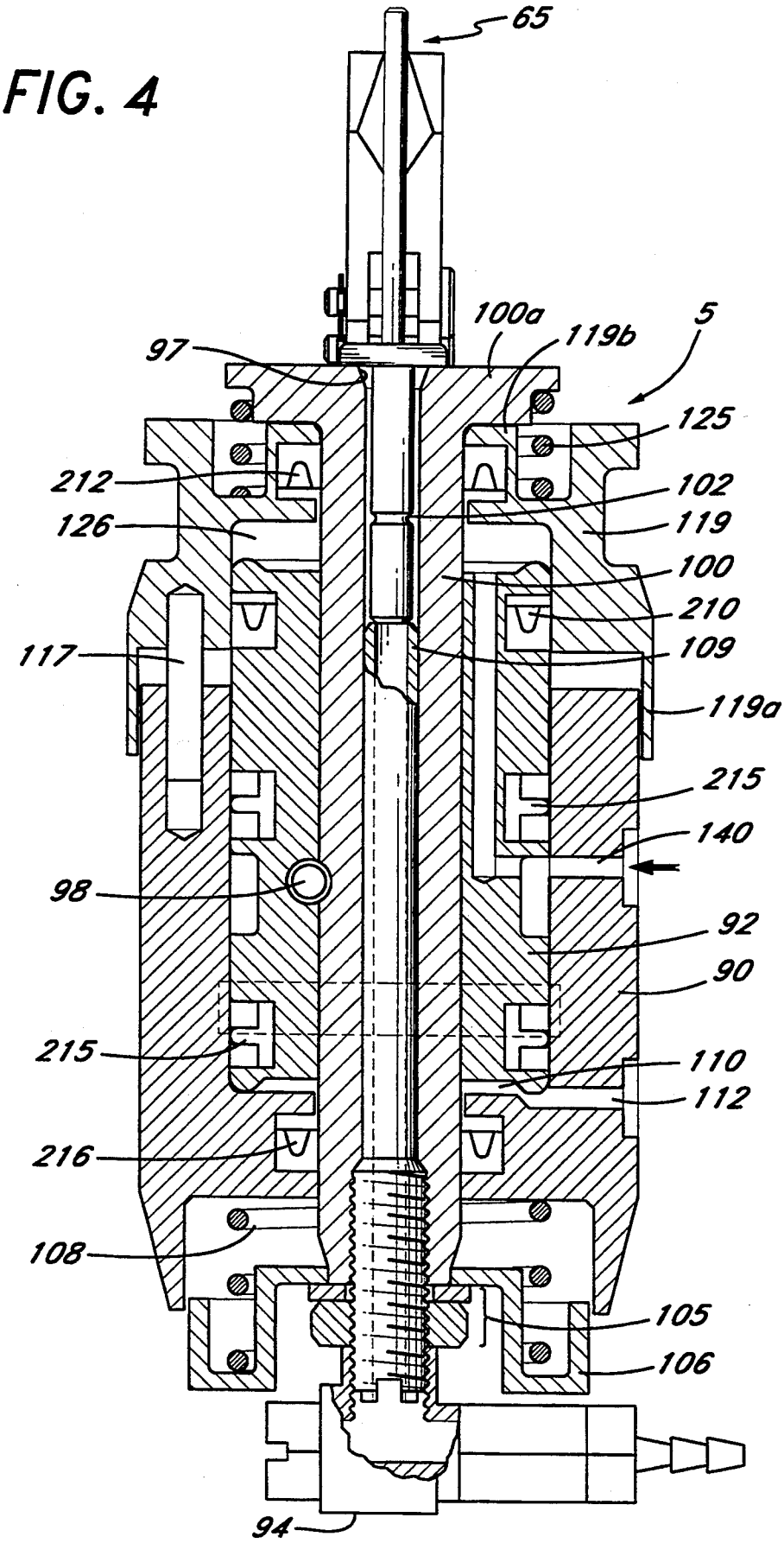
FIG. 4 is a cross-sectional view of the module taken along line 4—4 of FIG. 3 with a fastener assembly in place.

The displacement shaft 100 has a cylindrical interior bore or channel 102 which receives a fastener in its upper end, as seen in FIG. 4. The entry 97 at the upper end of the channel 102 is flared to allow for easy insertion of the fastener assembly 65. However, the entry is small enough such that the fastener sleeve head 68 will not fit into the channel 102.

Slidably positioned within the channel 102 is an elongated tubular stopper 109, the forward end of which limits the insertion of the fastener 65. The rear of the stopper is externally threaded to mate with an internally threaded rear portion of the shaft 100. This threaded arrangement allows the user to adjust the length of the stopper to accommodate fasteners of different lengths.

The lower end of the interior channel 102 is connected to a vacuum source (not shown) by a fitting 94 which threads over the end of the stopper 109.

An annular retainer 106 fits on the tapered rear end of the displacement shaft 100 and is held there by a washer and nut assembly 105, wherein the nut is threaded onto the rear of the stopper 109, and the washer abuts the rear of the displacement shaft 100. A coil displacement spring 108 is compressed between the housing and the retainer, to urge the shaft 100 rearwardly.

Figure 5:
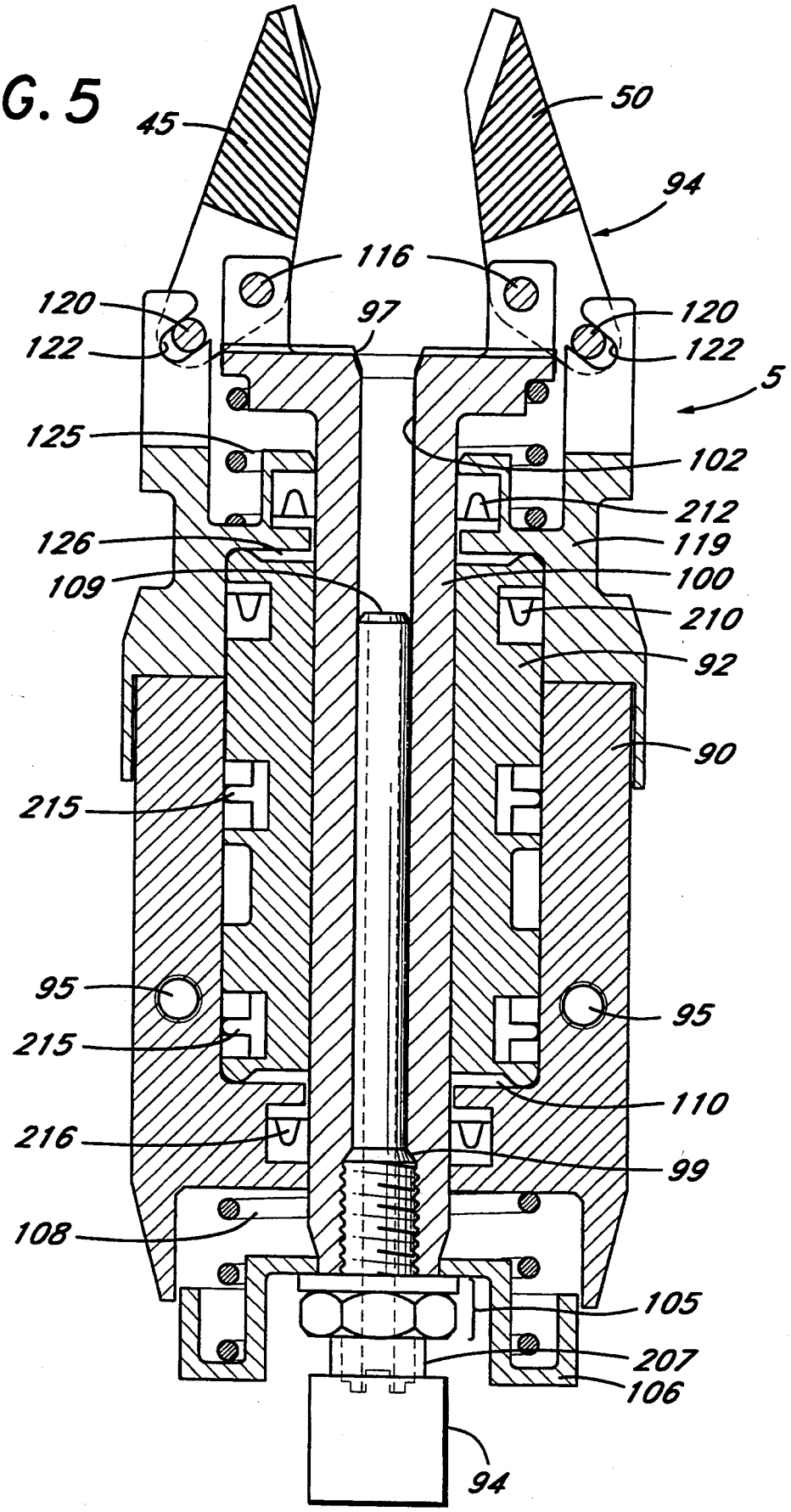
FIG. 5 is a cross-sectional view of the module of FIG. 4 rotated 90 degrees about its longitudinal axis with the fingers in the open position.

Located on the forward or upper end of the module 5 is a fastener gripper assembly 94 which includes a housing 119 that is connected to a pair of fingers 45 and 50. As seen in FIG. 5, the forward end of the displacement shaft 100 includes a radially extending flange **100*a* that has a pair of pivot mounts on its forward end for pivotally receiving central portions of the fingers 45 and 50 by way of pivot pins 116**.

The gripper housing 119 is an annular, shell-like member which mates with and forms a moveable upper end of the housing 90, with the upper end of the spool 92 slidably positioned in the gripper housing. The housing 119 is thus somewhat like a piston. The gripper housing 119 is movably joined to the main housing 90 by a pin 117 (FIG. 4). In the arrangement shown, the pin 117 is anchored in the gripper housing 119, while the lower ends slide within mating sockets in the main housing 90. A depending cylindrical skirt **119*a* surrounds the upper end of the housing 90. The upper end of the housing 119 extends radially inwardly forming an annular wall 119*b*, which in combination with the upper end of the spool 92 and a portion of the shaft 100 forms a gripper chamber 126. An air inlet/exhaust passage 140 extends from the chamber 126, axially through the spool 92 and radially through the spool and through the side wall of the housing 90 for connection to the air source of FIG. 1. A sealing ring 215 positioned in an annular groove in the spool 92 seals the lower end of the passage 140 and a sealing ring 210 positioned in an upper annular groove in the spool 92 seals the lower end of the chamber 126, while the upper end of the chamber 126 is sealed by a ring 212 carried in a groove in the housing 119 and surrounding the shaft 100**.

The upper portion of the gripper housing 119 is formed with a pair of diametrically-spaced, open-ended slots 122 that receive finger pins 120 that extend through the lower ends of the fingers 45 and 50. A coil compression spring 125 is confined between the end wall of an annular space in the upper end of the housing 119 and the lower surface of the flange **100*a* on the shaft 100. As can be seen from FIG. 5, the compression spring urges the housing 119 downwardly into engagement with the housing 90; and this action pivots the lower ends of the fingers 45 and 50** downwardly causing the fingers to move into the open position.

Figure 8B:
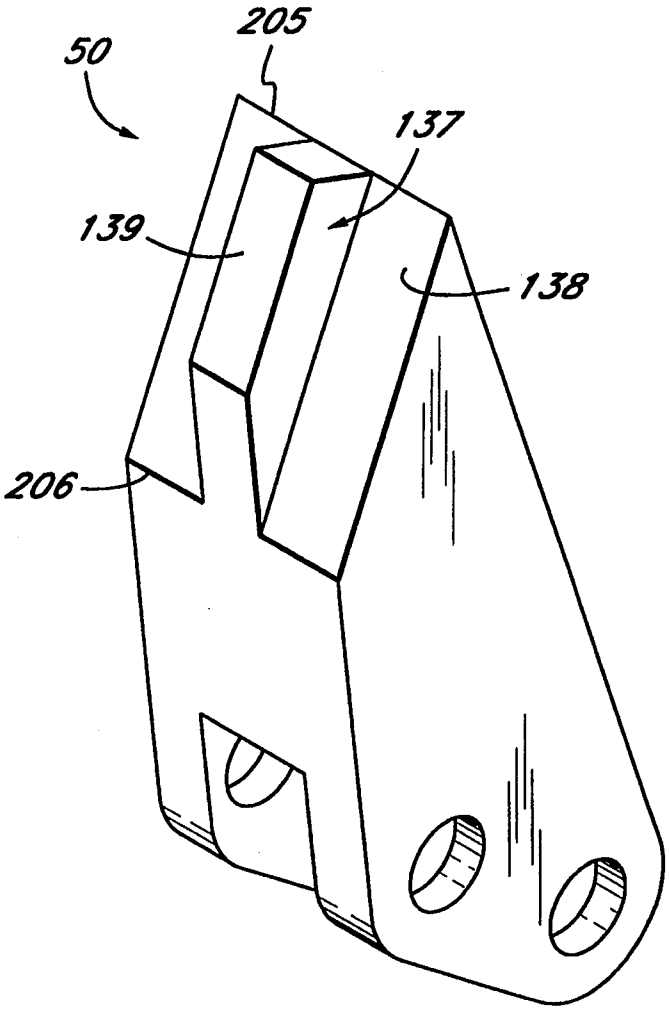
FIG. 8*b* is an enlarged view of the other finger of the gripper assembly of the receive and place module.
Figure 8A:
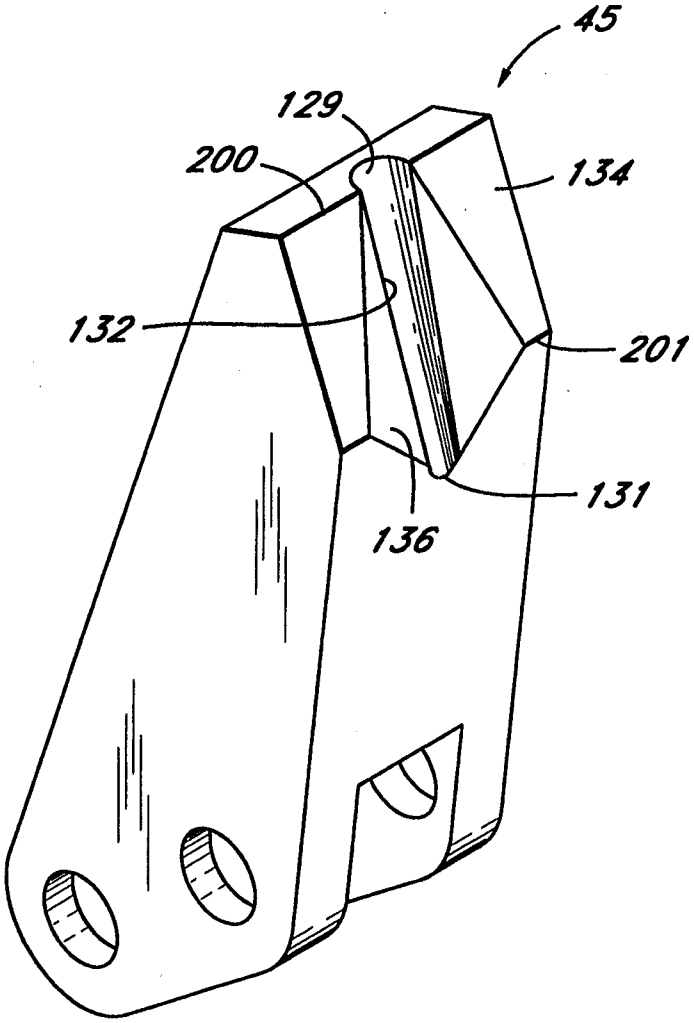
FIG. 8*a* is an enlarged view of one finger of the gripper assembly of the receive and place module.

FIG. **8*a* discloses a negative dihedral finger 45, while FIG. 8*b* discloses a biasing finger 50. The finger 45 has a tip surface 134 with a centrally located channel 132 with a semi-circular cross section. The diameter of the channel 132, unlike the depth, is uniform throughout its entire length. The channel 132 extends from the top edge 200 of the tip surface 134, past the bottom edge 201. On both sides of the channel 132, the tip surface 134 slopes down to meet the side edges of the channel 132. The widest part of this sloped surface 136 is at the bottom edge 201 of the tip surface 134. This sloped surface 136 is generally in the shape of a triangle. The channel depth gradually decreases from its top end 129 to its bottom end 131. The shape of the channel 132 facilitates the gripping of the stem pull portion 75 of the fastener assembly 65. The sloped surface 136 enables the stem 67 to be positioned within the channel 132 so long as the stem 67 is initially placed within the sloped surface 136**.

The biasing finger 50 in FIG. **8*b* has a projection 137 which has a generally flat contact surface 139 spaced from the tip surface 138. The sides of the projection 137 are perpendicular to the tip surface 138. The back portion of the projection 137 abutting the top edge 205 of the tip surface 138 is also perpendicular to the tip surface 138. However, the front of the projection 137 slants down at an angle to contact the bottom edge 206 of the tip surface 138. The projection 137 ensures that the stem 67 of the fastener assembly 65 will be positioned and buttressed into the channel 132 of the finger 45**.

Operation

Figure 2:
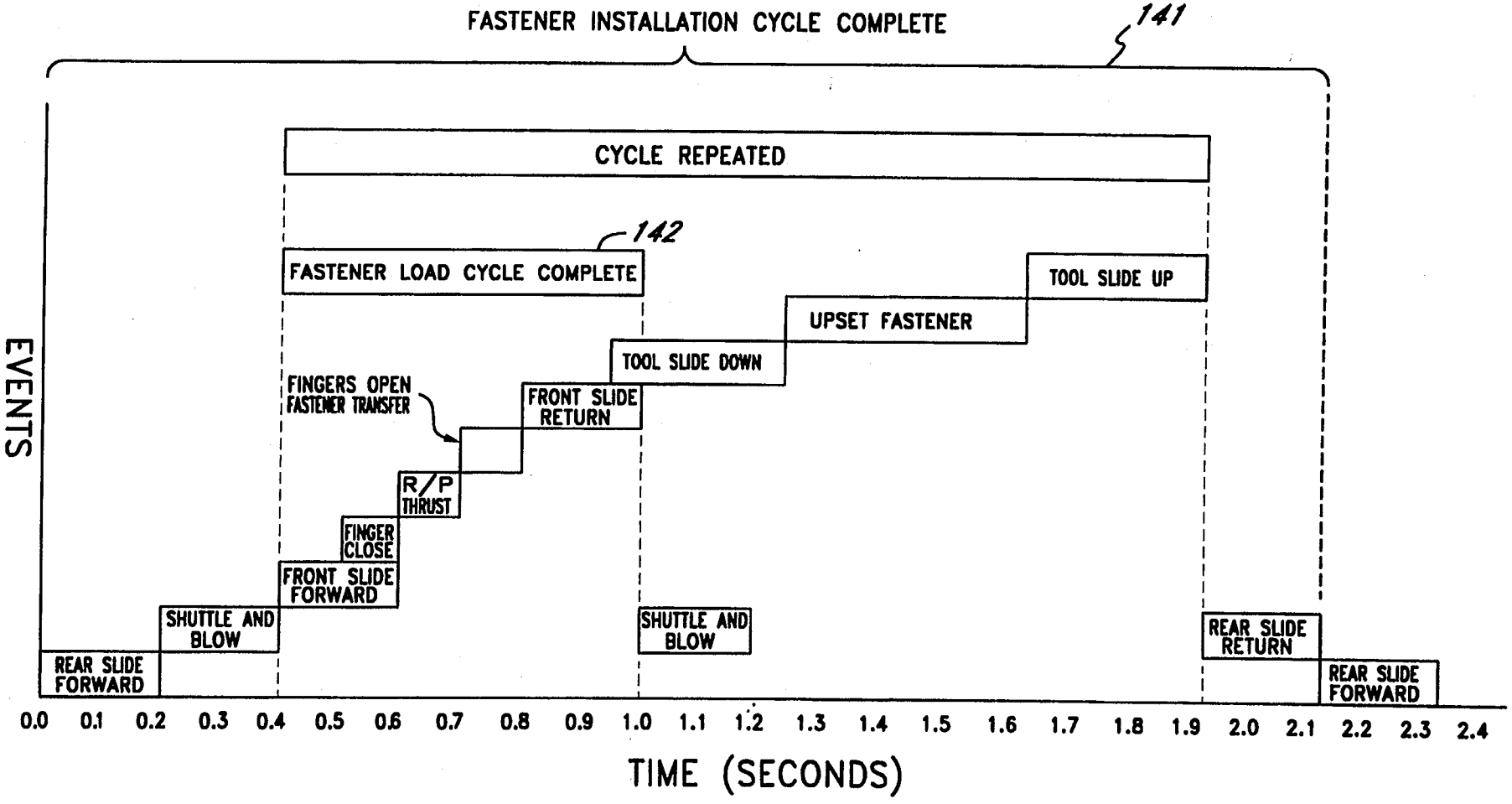
FIG. 2 is a schematic representation of the individual component events of the fastener installation cycle of the present invention with respect to time.
Figure 3:
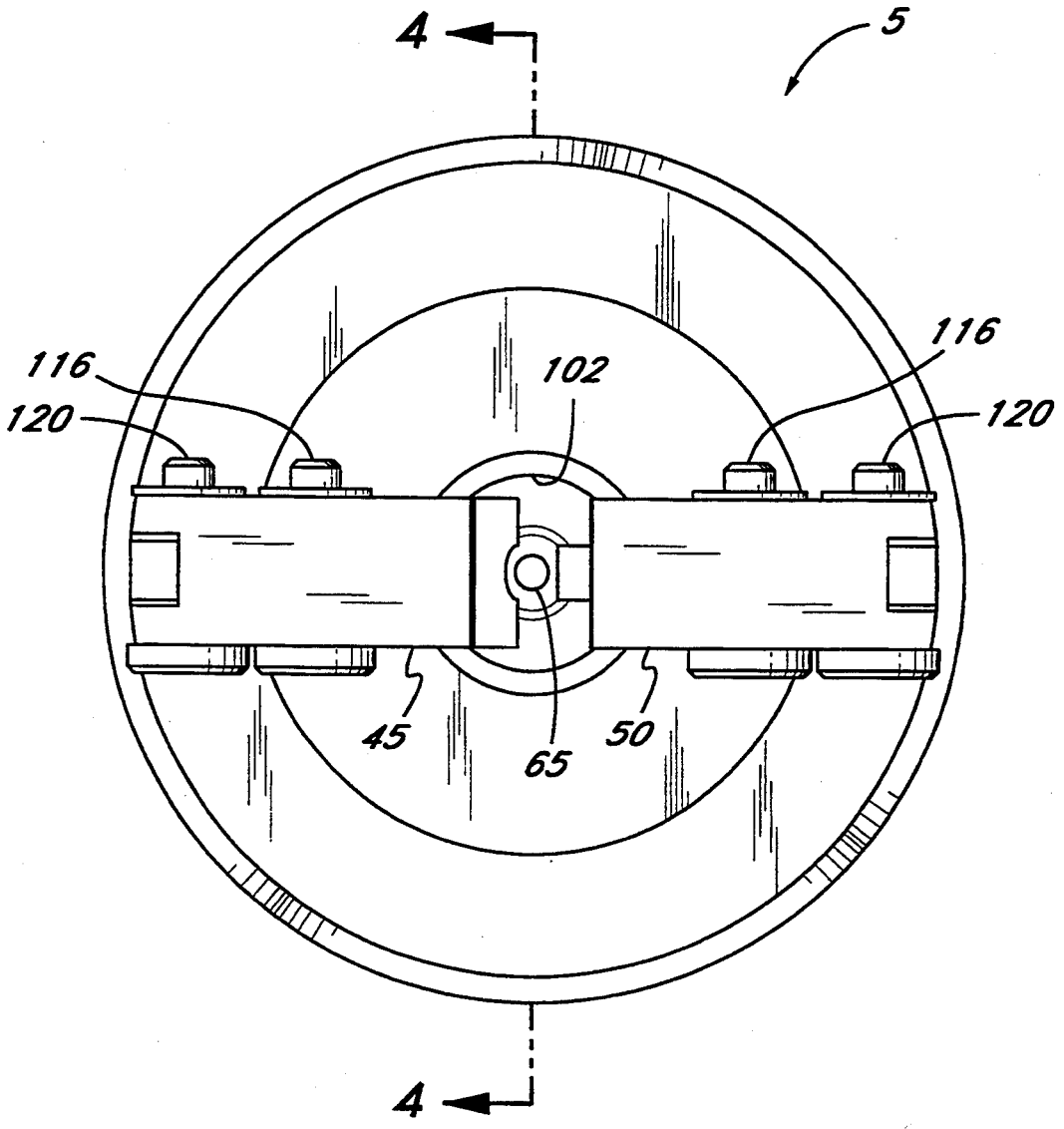
FIG. 3 is a top plan view of the fastener receive and place module with its fingers in the closed position.
Figure 9A:
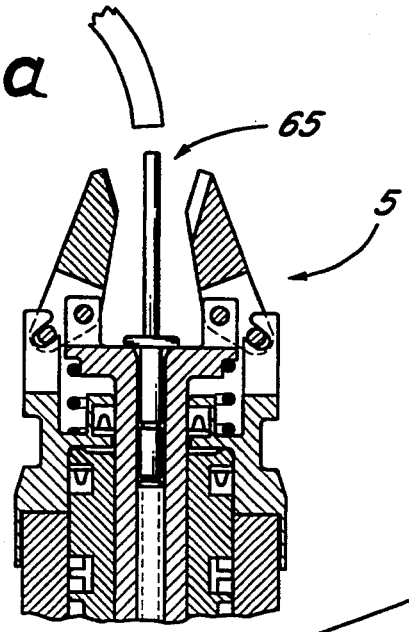
FIG. 9*a* is an enlarged cross-sectional view of the gripper assembly of FIG. 9 rotated 90 degrees to show the fingers in an open position in relation to the fastener assembly.
Figure 9:
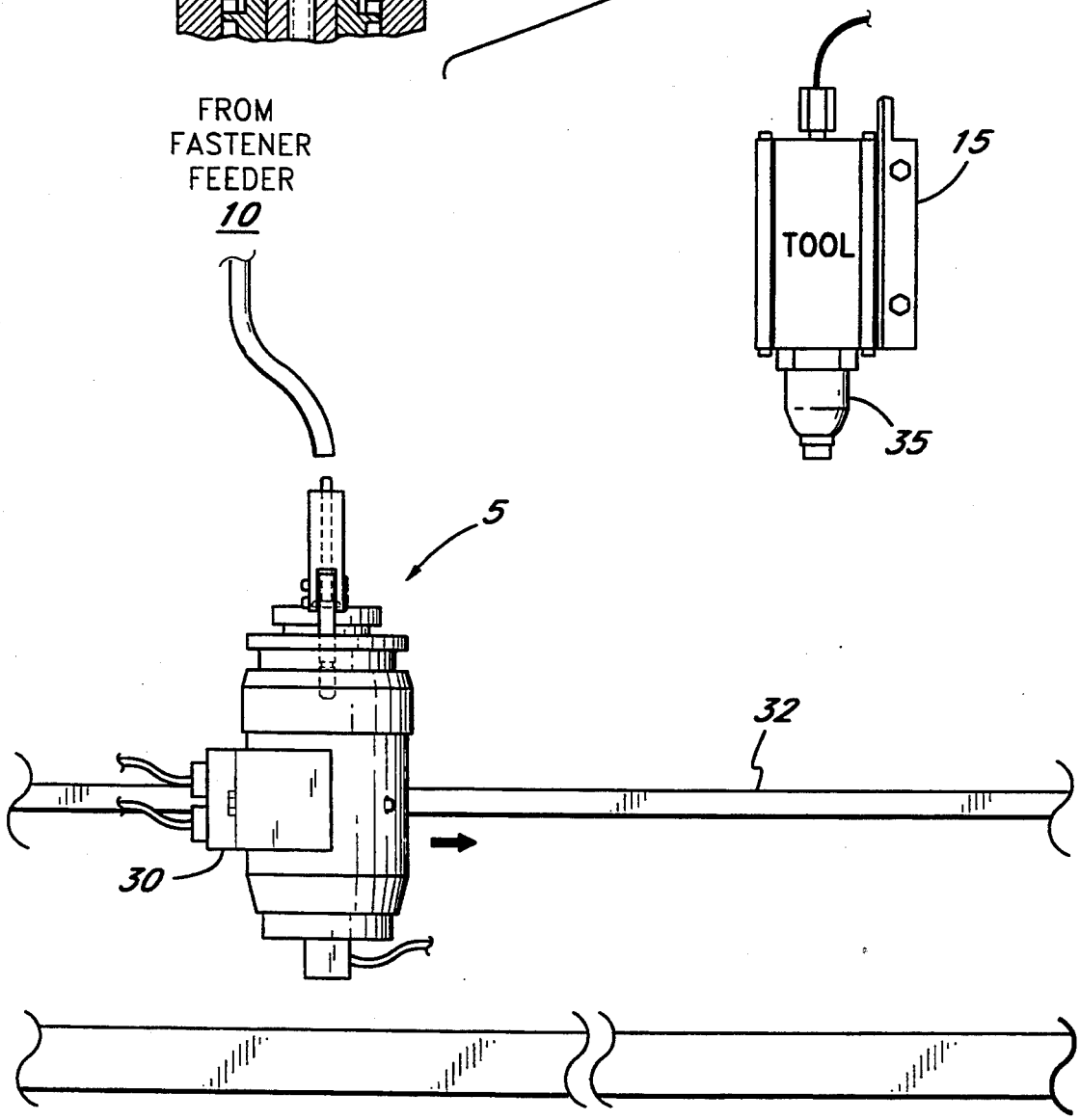
FIG. 9 is a schematic, side elevational view of the fastener receive and place module in the position which it occupies when it receives the fastener assembly from the fastener feeder.

In a preferred embodiment, the first step in a fastener installation cycle 141 is to have the module 5 move forward via the rear slide, into position to receive a fastener 65 from the fastener feeder 10, as in FIG. 1. As stated previously, the rear slide is only a design option. Moving the module 5 into alignment with the feeder 10 takes approximately 0.2 second with a production version of the system, as shown in FIG. 2. FIGS. 5, 9 and **9*a* show the orientation of the module 5 as it is aligned with the feeder 10 to receive the fastener assembly 65. As seen from FIGS. 5 and 9*a*, the piston or gripper housing 119 is in its normally open position, with the chamber 126 not pressurized, such that the housing 119 engages the upper end of the spool 92 and the housing 90 under the urging of the spring 125. With the housing 119 in this retracted position, the lower ends of the jaws 45 and 50** are moved downwardly, pivoting the fingers open.

The feeder 10 will then blow a fastener 65 into the channel 102 of the module 5 with the stem head 80 of the fastener assembly 65 entering first. As shown in FIG. 2, this step takes approximately 0.2 second. As can be seen in FIG. 4, when the fastener 65 is shot into the channel 102, the stopper 109 in conjunction with the top surface of the displacement shaft 100 will limit the movement of the fastener 65 into the channel 102. Thus, the stem pull portion 75 extends upwardly between the fingers 45 and 50. This will greatly reduce the incidence of the body 66 moving with respect to the stem 67.

Once the fastener 65 is received within the channel 102, the load cycle 142 can begin. The fastener 65 will stay positioned in the channel 102 via a vacuum applied through the interior bores of the fitting 94, the stopper 109, and the shaft 100. A sensor (not shown) located within the channel 102 will alert the control unit 25 (shown in FIG. 1) that the load cycle 142 can begin.

The module 5 will then slide forward via the front slide 32 to align itself with the tool 15. In a preferred embodiment, the front slide will take a linear path, but as previously stated, the module 5 can take a circumferential path. During this forward movement, pneumatic pressure applied to the gripper chamber 126 will be actuated to cause the fingers 45 and 50 to close and grip the stem pull portion 75 of the fastener 65. More specifically, air applied to the gripper chamber 126 causes it to expand and displace the gripper housing 119 upwardly in a direction away from the main housing 90 and the displacement spool 92. This compresses the gripper spring 125, as shown in FIGS. 4 and 6. The extending movement of the piston or housing 119 causes the fingers 45 and 50 to pivot and grip the stem 67. In accordance with the invention, the fingers 45, 50 grip the stem 67 close to but spaced a short distance from the outer tip of the stem pull portion 75. The precise portioning of the fastener body 66 and the straightness of the stem become unimportant, since the stem is gripped so close to the tip. The gripping of the stem 67 will take approximately 0.1 second. In a preferred embodiment, about 8 pounds of force is applied by the fingers 45 and 50. This amount of force has proven adequate to fulfill the objectives of this invention. It will take approximately 0.2 second to have the module 5 align itself with the tool 15 with the fingers 45,50 gripping the stem 67, as shown in FIG. 2.

Figure 10A:
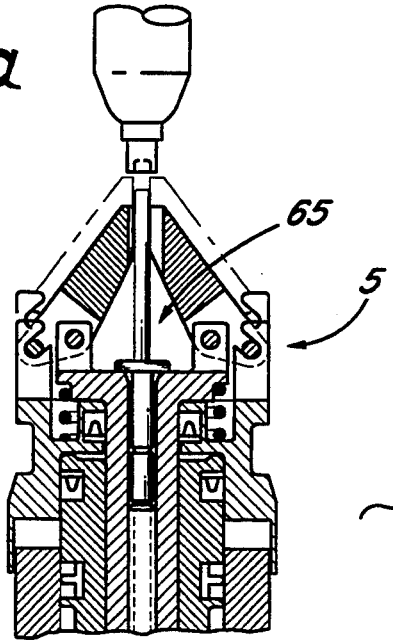
FIG. 10*a* is an enlarged cross-sectional view of the gripper assembly of FIG. 10 rotated 90 degrees to show the fingers gripping the fastener stem and showing in phantom the physical insertion of the fastener assembly into the nose of the tool.
Figure 10:
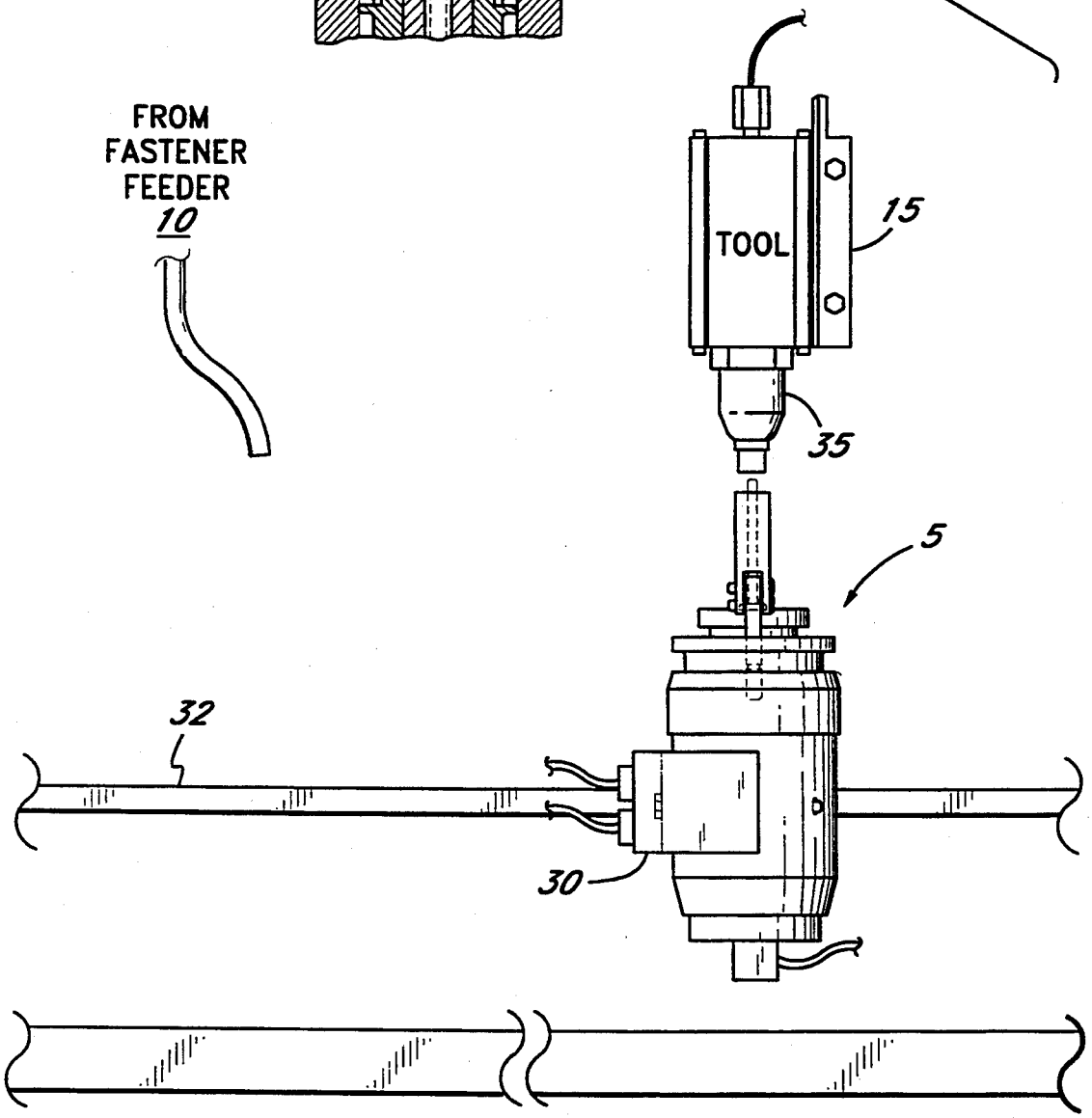
FIG. 10 is a schematic side elevational view of the fastener receive and place module in the position it occupies when it delivers the fastener assembly to the fastener-setting tool.

Once the module 5 is aligned under the tool 15 with its fingers 45,50 gripping the stem pull portion 75 as shown in FIGS. 10 and 10*a*, the next step is to displace the module 5 relative to the tool 15. Applying pneumatic pressure to expand the displacement chamber 110 will actuate the spool 92, causing it to move upwardly towards the tool 15 relative to the stationary main housing 90. Since the displacement spool 92 and the displacement shaft 100 are connected by the spring pin 98, the movement of the spool 92 will simultaneously move the shaft 100. The retainer 106 moves with the shaft, compressing the displacement spring 108. FIG. 2 shows that displacing the shaft 100 toward the tool 15 takes approximately 0.1 second.

The displacement of the module 5 physically inserts the stem pull portion 75 into the bore of the nosepiece 35 of the tool 15. Unlike methods that shoot the fastener assembly 65, a short distance through the air into the nosepiece 35 of the tool 15, this physical insertion is very precise. Coupling this physical insertion with the gripping of the stem 67 near its tip produces great precision. This method is especially important when it comes to the loading of a fastener to a staking tool. Staking tools have a bore which will not allow for a large degree of variance between the diameters of the bore and the stem.

Once the tip of the stem pull portion 75 of the fastener 65 is inserted in the nosepiece 35, the vacuum present in the channel 102 will be converted into positive air pressure.

Figure 7:
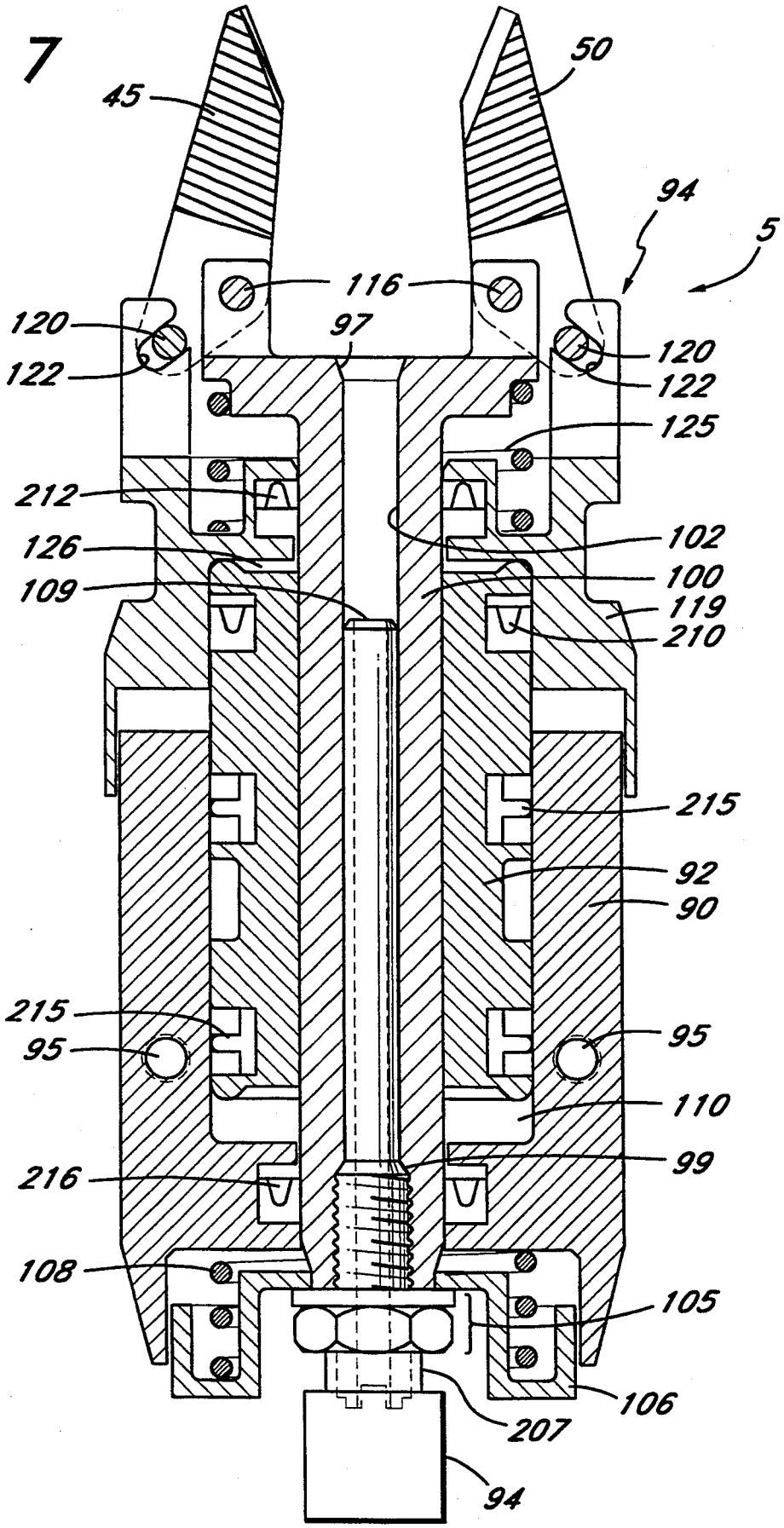
FIG. 7 is a cross-sectional view of the module of FIG. 4 displaced in an axial direction, with the fingers in the open position.

Simultaneously, the pressure in the gripper chamber 126 is exhausted, thus eliminating the high pressure allowing the gripper spring 125 to expand, retracting the housing 119 and pivoting the fingers 45,50 into the open position. The module 5 will appear as shown in FIG. 7. Opening the fingers 45 and 50 takes approximately 0.1 second as shown in FIG. 2. When the fingers 45, 50 open, positive air pressure in the channel 102 and a vacuum in the bore of the tool 15, will cause the fastener 65 to shoot further into the tool 15.

Once the fastener 65 is located in the tool 15, the module 5 will start to slide in reverse via the front slide 32, to realign itself with the feeder 10 to receive another fastener 65. Due to the orientation of the fingers 45 and 50 shown in FIG. 7, the fingers 45 and 50 will not engage the fastener 65 during this movement. As the module 5 rearwardly slides back into alignment with the feeder 10, the air in the displacement chamber 110 will be simultaneously released causing the displacement spring 108 to extend and retract the spool 92 and the shaft 100. This reverse movement will take approximately 0.2 second as shown in FIG. 2. Once the module 5 is realigned with the feeder 10, the load cycle 142 is complete. The load cycle 142 for loading one fastener will take approximately 0.6 second as disclosed in FIG. 2. This load cycle 142 can be repeated as needed.

Proceeding with the installation cycle 141, one can see from the table on FIG. 2, that the tool 15 will start to vertically descend to insert the fastener 65 in the workpiece before the module 5 is fully realigned with the feeder 10. The descent of the tool 15 takes approximately 0.3 second, as shown in FIG. 2. However, this number can vary depending upon the operator and/or type of operation. Once the module 5 is realigned with the feeder 10, the feeder 10 will reinitiate the shuttle and blow operation while the tool 15 is installing the fastener 65. This shuttle and blow segment will once again take approximately 0.2 second.

After the fastener 65 is inserted in the workpiece, the tool 15 will then upset and lock the fastener 65 in the workpiece by pulling the stem pull portion 75, which takes approximately 0.4 second according to FIG. 2. Once again, this time can vary depending upon the operator and/or type of operation. Once this is accomplished, the tool 15 will vertically retract to its initial position, which takes approximately 0.3 second. This time will also vary depending upon the operator and/or type of operation. The installation of one fastener is now complete. This installation process can be repeated as needed. Once all the necessary fasteners 65 have been installed in the workpiece, the module 5 will retract via the slower moving rear slide so that the completed workpiece can be removed and a new workpiece inserted. This rear slide movement takes approximately 0.2 second. The installation cycle 141 is now complete. FIG. 2 shows that the installation cycle 141 for installing one fastener is a little more than 2.1 seconds.

What is claimed is:

1. An apparatus for automatically feeding fasteners to a fastener-setting tool, said fasteners including a sleeve with a head on one end, and a stem extending through said sleeve and including an elongated step pull portion extending outwardly from the head end of said sleeve to be gripped and pulled by said tool and an enlarged stem head extending outwardly from a tail of said sleeve for deforming said tail, said apparatus comprising a fastener receive and place module including:

a main housing;

a tubular displacement shaft slidably received within said main housing and containing an interior channel for receiving said sleeve and said stem head with said sleeve head and said stem pull portion extending outwardly therefrom;

an axially movable tubular displacement spool located within said main housing surrounding said shaft, and connected to move with said shaft;

an expandable displacement chamber formed by a lower axial end face of said spool said shaft and said main housing a displacement spring confined beneath said main housing for urging said shaft away from said tool;

a stem gripper assembly connected to said displacement shaft for gripping said stem pull portion;

said stem gripper assembly comprising a pair of fingers, adapted to grip said stem pull portion;

an expandable gripper chamber and a gripper spring for moving said fingers between open and closed positions;.

a stem gripper housing axially positioned on one end of said main housing and being slidable axially with respect to said main housing;

said gripper housing being slidably mounted on an upper end of said spool with said expandable gripper chamber being formed by said gripper housing, the upper end of said spool and said shaft;

said gripper spring extending between said gripper housing and said shaft to urge said gripper housing into its retracted position on said spool; and said gripper housing being connected to said gripper assembly in a manner such that expanding said gripper chamber to extend said gripper housing urges said fingers into said closed position.

2. An apparatus for automatically feeding fasteners to a fastener-setting tool, said fasteners including a sleeve with a head on one end, and a stem extending through said sleeve and including an elongated stem pull portion extending outwardly from the head end of said sleeve to be gripped and pulled by said tool and an enlarged stem head extending outwardly from a tail of said sleeve for deforming said tail, said apparatus comprising a fastener receive and place module including:

a main housing;

a tubular displacement shaft slidably received within said main housing and containing an interior channel for receiving said sleeve and said stem head with said sleeve head and said stem pull portion extending outwardly therefrom;

an axially movable tubular displacement spool located within said main housing surrounding said shaft, and connected to move with said shaft;

an expandable displacement chamber formed by a lower axial and face of said spool said shaft and said main housing a displacement spring confined beneath said main housing for urging said shaft away from said tool;

a stem gripper assembly connected to said displacement shaft for gripping said stem pull portion;

said stem gripper assembly comprising a pair of fingers adapted to grip said stem pull portion;

an expandable gripper chamber and a gripper spring for moving said fingers between open and closed positions;

a stem gripper housing axially positioned on one end of said main housing and being slidable axially with respect to said main housing;

an gripper housing being slidably mounted on the upper end of said spool with said expandable gripper chamber being formed by said gripper housing, the upper end of said spool and said shaft;

said gripper spring extending between said gripper housing and said shaft to urge said gripper housing into its retracted position on said spool;

said gripper housing being connected to said gripper assembly in a manner such that expanding said gripper chamber to extend said gripper housing urges said fingers into said closed position;

said fingers being pivotably mounted on an upper end of said shaft at a location between a stem-gripping end and an actuating end of each of said fingers; and said gripper housing being linked to said finger actuating ends to pivot said fingers into closed position when said gripper housing is extended.

* * * * *